US010274897B2

(12) United States Patent
Ikeda et al.

(10) Patent No.: US 10,274,897 B2
(45) Date of Patent: Apr. 30, 2019

(54) SPEED GOVERNOR FOR TIMEPIECE

(71) Applicant: CITIZEN WATCH CO., LTD., Nishitokyo-shi, Tokyo (JP)

(72) Inventors: Tomoo Ikeda, Shiraoka (JP); Yusaku Niida, Tokorozawa (JP); Yosuke Abe, Fuchu (JP)

(73) Assignee: CITIZEN WATCH CO., LTD., Nishitokyo-Shi, Tokyo (JP)

( * ) Notice: Subject to any disclaimer, the term of this patent is extended or adjusted under 35 U.S.C. 154(b) by 0 days.

(21) Appl. No.: 15/736,695

(22) PCT Filed: Jun. 1, 2016

(86) PCT No.: PCT/JP2016/066198
§ 371 (c)(1),
(2) Date: Dec. 14, 2017

(87) PCT Pub. No.: WO2016/203953
PCT Pub. Date: Dec. 22, 2016

(65) Prior Publication Data

US 2018/0150030 A1 May 31, 2018

(30) Foreign Application Priority Data

Jun. 15, 2015 (JP) ..... 2015-120320

(51) Int. Cl.
*G04B 17/22* (2006.01)
*G04B 17/06* (2006.01)

(52) U.S. Cl.
CPC ..... *G04B 17/222* (2013.01); *G04B 17/063* (2013.01); *G04B 17/066* (2013.01)

(58) Field of Classification Search
CPC .... G04B 17/222; G04B 17/06; G04B 17/063; G04B 17/22; G04B 17/066; G04B 17/227
(Continued)

(56) References Cited

U.S. PATENT DOCUMENTS 6,329,066 B1 * 12/2001 Baur ..... G04B 17/227 368/161
7,824,097 B2 * 11/2010 Lippuner ..... G04B 15/14 368/124
(Continued)

FOREIGN PATENT DOCUMENTS

CH 699780 A2 4/2010
CH 707669 B 9/2014
(Continued)

OTHER PUBLICATIONS

International Search Report received in PCT Application No. PCT/JP2016/066198 dated Sep. 6, 2016.
(Continued)

*Primary Examiner* — Edwin A. Leon
(74) *Attorney, Agent, or Firm* — Knobbe, Martens, Olson & Bear LLP

(57) ABSTRACT

A governor includes a balance spring including a base member made of silicon, for example, and a balance wheel. The balance spring includes a coating film of DLC that is applied to a surface of the silicon base member to improve the strength of the balance spring. A spring constant of the balance spring changes in accordance with the temperature change. A moment of inertia of the balance wheel changes in accordance with the temperature change. A change in an oscillation period due to the temperature change is suppressed by the change in the spring constant of the balance spring and by the change in the moment of inertia of the balance wheel.

8 Claims, 11 Drawing Sheets

(58) Field of Classification Search
USPC ..... 368/171, 175
See application file for complete search history.

(56) References Cited

U.S. PATENT DOCUMENTS

| | | | | |
|---|---|---|---|---|
| 8,425,110 | B2 * | 4/2013 | Zaugg | G04B 17/066 368/177 |
| 2005/0281137 | A1 * | 12/2005 | Bourgeois | F16F 1/021 368/175 |
| 2008/0037376 | A1 | 2/2008 | Lippuner et al. | |
| 2010/0034057 | A1 | 2/2010 | Levingston | |
| 2010/0054090 | A1 | 3/2010 | Orny et al. | |
| 2010/0214880 | A1 | 8/2010 | Rappo et al. | |
| 2012/0230159 | A1 | 9/2012 | Hessler et al. | |
| 2013/0135974 | A1 | 5/2013 | Niedermann et al. | |

FOREIGN PATENT DOCUMENTS

| | | | |
|---|---|---|---|
| CN | 101042570 | A | 9/2007 |
| EP | 1837721 | A1 | 9/2007 |
| EP | 1837722 | A2 | 9/2007 |
| EP | 2062101 | A | 5/2009 |
| EP | 2337221 | A1 | 6/2011 |
| EP | 2597536 | A1 | 5/2013 |
| GB | 617662 | | 2/1949 |
| GB | 701299 | A | 12/1953 |
| HK | 1113948 | A | 7/2012 |
| JP | 2007-256290 | A | 10/2007 |
| JP | 3154091 | U | 10/2009 |
| JP | 4515913 | B | 8/2010 |
| JP | 2013-170940 | A | 9/2013 |
| JP | 2013-195297 | A | 9/2013 |
| JP | 2013-231728 | | 11/2013 |
| KR | 10-2007-0096834 | A | 10/2007 |
| TW | 200801867 | A | 1/2008 |
| WO | WO 2008/029158 | A2 | 3/2008 |
| WO | WO 2008/080570 | A1 | 7/2008 |

OTHER PUBLICATIONS

Written Opinion received in PCT Application No. PCT/JP2016/066198 dated Sep. 6, 2016.
Extended European Search Report; Application No. 16811428.8; dated Jan. 3, 2019; 7 pages.

* cited by examiner

SPEED GOVERNOR FOR TIMEPIECE

CROSS-REFERENCE TO RELATED APPLICATIONS

This application is the U.S. National Phase under 35 U.S.C. § 371 of International Application No. PCT/JP2016/066198, filed on Jun. 1, 2016, which claims priority to Japanese Patent Application No. 2015-120320, filed on Jun. 15, 2015. The entire contents of these applications are incorporated herein by reference.

TECHNICAL FIELD

This invention relates to a governor for a timepiece.

BACKGROUND ART

A governor for a mechanical timepiece accurately regulates a rate of the timepiece. The governor includes a balance spring and a balance wheel. The balance spring has been made of metal. However, the balance spring made of silicon has been recently used. The silicon balance spring can be formed by a semiconductor process, which makes the dimensional accuracy of the silicon balance spring more accurate than that of the metal balance spring. However, the silicon balance spring is less durable against impact compared to the metal balance spring. Therefore, a silicon balance spring, the base material of which is applied with a strength enhancing coating such as a diamond-like carbon (DLC), has been known.

However, the balance spring with such a coating has a problem related to temperature characteristics that the change rate of the spring constant relative to temperature increases to deteriorate the accuracy of the rate of the timepiece compared to that of the balance spring with no coating. Deterioration of the temperature characteristics of the balance spring prevents the governor from accurately regulating the rate of the timepiece. Meanwhile, it is also known that a silicon balance spring with a coating such as a silicon dioxide (SiO2) coating improves the strength of the balance spring, and also improves the temperature characteristics of the balance spring (see Patent Literature 1: JP 3154091 U and Patent Literature 2: JP 4515913 B, for example)

SUMMARY

However, to improve the temperature characteristics with the silicon dioxide coating, the thickness of the coating has to be, for example, 5 μm or more to obtain a substantial effect. In addition, it takes several tens of hours to form such a thick coating. In addition, the silicon dioxide coating requires an expensive oxidizing furnace. The present invention has been made in view of the above problems, and an object of the present invention is to provide a governor for a timepiece capable of improving the strength of a balance spring and preventing or suppressing deterioration in the accuracy of a rate of the timepiece due to a temperature change while reducing manufacturing cost.

A governor for a timepiece according to the present invention includes a balance spring, and a balance wheel. The balance spring includes a base member that has a spiral shape, and a coating film that is applied to a surface of the base member to improve strength of the balance spring. A spring constant of the balance spring changes in accordance with temperature change. A moment of inertia of the balance wheel changes in accordance with the temperature change. A change in an oscillation period due to the temperature change is suppressed by the change in the spring constant of the balance spring and by the change in the moment of inertia of the balance wheel.

DETAILED DESCRIPTION

Hereinafter, embodiments of a governor according to the present invention are described with reference to drawings.

Configuration of Governor

Figure 1:
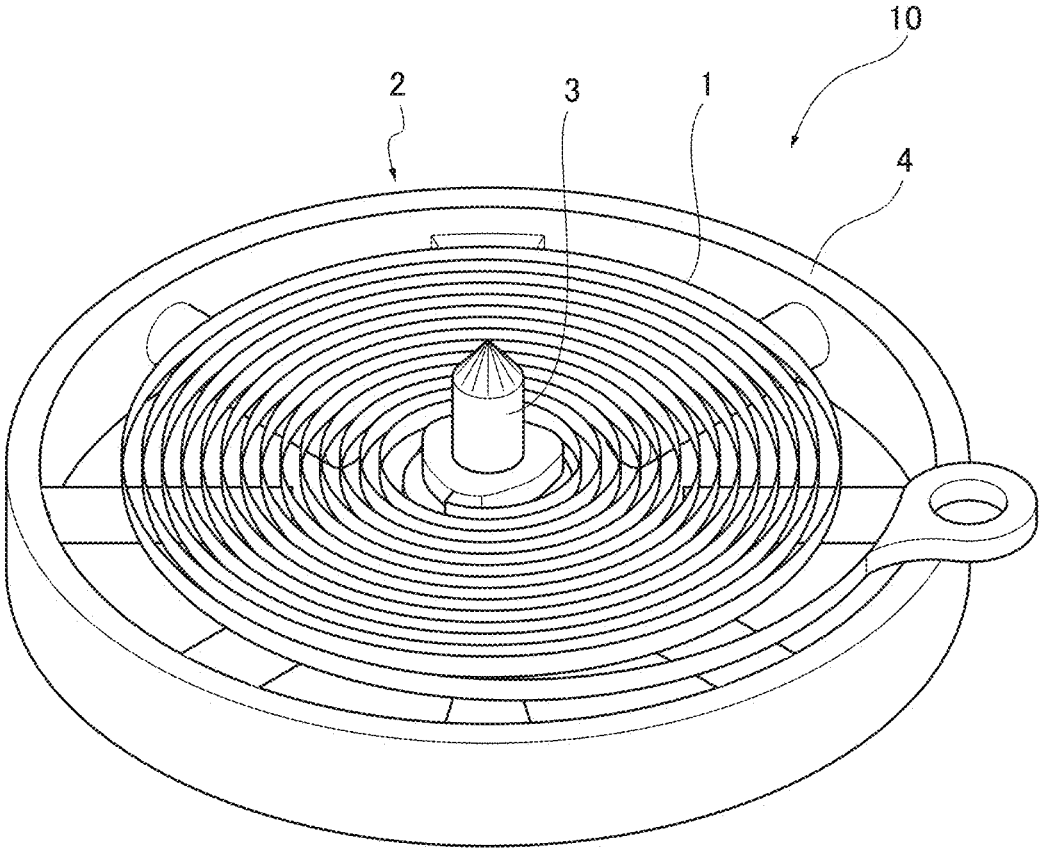
FIG. 1 is a plan view illustrating a governor in a portable timepiece (a wristwatch, for example) according to an embodiment of the present invention.
Figure 2:
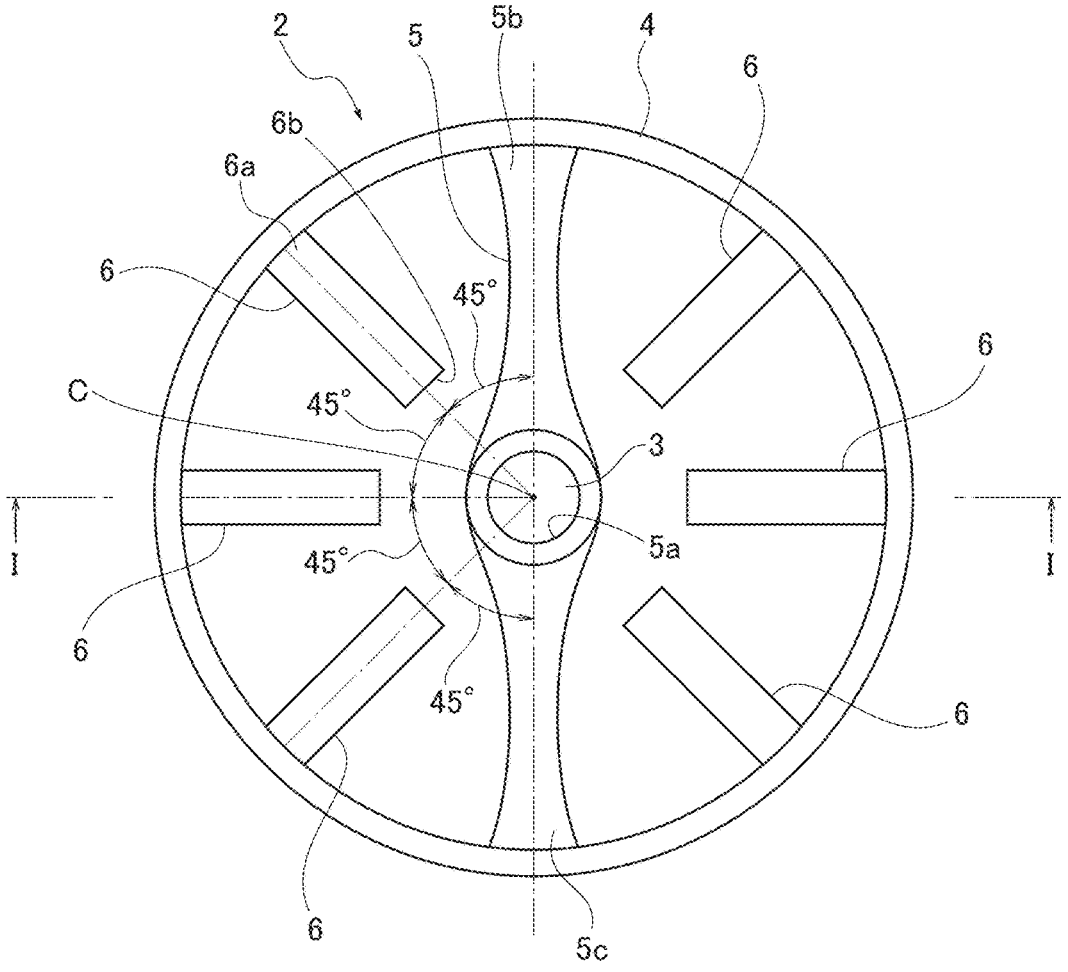
FIG. 2 is a plan view illustrating a balance wheel in FIG. 1.

FIG. 1 is a plan view illustrating a governor (balance) 10 in a portable timepiece (a wristwatch, for example) in accordance with an embodiment of the present invention. FIG. 2 is a plan view illustrating a balance wheel 2 in FIG. 1.

As shown in FIG. 1, the governor 10 of a first embodiment includes a balance spring 1 and a balance wheel 2.

The balance spring 1 is made of silicon, for example. The balance spring 1 is formed from a silicon wafer by a semiconductor process and has a spiral shape. In addition, the balance spring 1 includes a coating of diamond-like carbon (DLC) applied to a surface thereof. Specifically, the balance spring 1 includes a base member made of silicon and a coating film of DLC applied to the surface of the base member. The thickness of the DLC coating is about 1 μm, for example. The strength of the balance spring 1 is improved compared to a balance spring with no DLC coating (a spiral shaped base member). The balance spring 1 includes an inner end fixed to a balance staff 3 of the balance wheel 2, and an outer end fixed to a balance cock in a movement of the portable timepiece.

As shown in FIG. 2, the balance wheel 2 includes the balance staff 3, an arm portion 5, a rim portion 4, and weight members 6. The arm portion 5 and the rim portion 4 form a support member. The arm portion 5 includes a through hole 5*a* at a center C of the arm portion 5 for receiving the balance staff 3. The arm portion 5 includes end portions 5*b*, 5*c*. A length between the center C and the end portion 5*b* is the same as a length between the center C and the end portion 5*c*. The balance staff 3 is inserted into the through hole 5*a* of the arm portion 5 such that upper and lower pivots of the balance staff 3 are ratably supported by the balance cock and a main plate in the movement of the portable timepiece, respectively.

The rim portion 4 has a circular ring shape and fixed to the end portions 5*b*, 5*c* of the arm portion 5. With the arm portion 5 fixed to the rim portion 4, the center C is coincident with the center of the rim portion 4, and the arm portion 5 extends from the center C to the rim portion 4. Note that the arm portion 5 and the rim portion 4 may be integrally formed or may be separate members fixed to each other. The arm portion 5 and the rim portion 4 are made of alloy, such as Invar (registered trademark), in which nickel is added to iron, for example, and the coefficient of thermal expansion at around room temperature (normal temperature) is extremely small.

Each of the weight members 6 is a column bar, and is made of, for example, copper having a larger coefficient of thermal expansion than coefficients of the thermal expansion of the arm portion 5 and the rim portion 4 at around the room temperature. In the embodiment, the coefficient of the thermal expansion of the weight member 6 is at least six times larger than the coefficients of the thermal expansion of the arm portion 5 and the rim portion 4. Also, in the embodiment, the weight member 6 has an outer end 6*a* in an axial direction thereof, which is fixed to the rim portion 4, and extends radially inward from the rim portion 4. In other words, the weight member 6 is supported by the rim portion 4 at the outer end 6*a* in the radial direction of the rim portion 4. On the other hand, an inner end 6*b* of the weight member 6 in the radial direction of the rim portion 4 does not contact any elements and accordingly is not restrained.

The weight member 6 and the rim portion 4 may be fixed to each other by fastening with screws, attaching with an adhesive, fitting with convex and concave portions, welding, brazing, and the like. The balance wheel 2 includes six weight members 6. The six weight members 6 are arranged around the center C at angular intervals of 45 degrees from the longitudinal axis of the arm portion 5.

When thermal expansion or thermal contraction occurs in accordance with the temperature change, the weight member 6 extends from or contracts toward the outer end 6*a* in the radial direction of the rim portion 4 since the inner portion 6*b* is not constrained but the outer portion 6*a* is constrained.

Operation of Governor

Figure 3A:
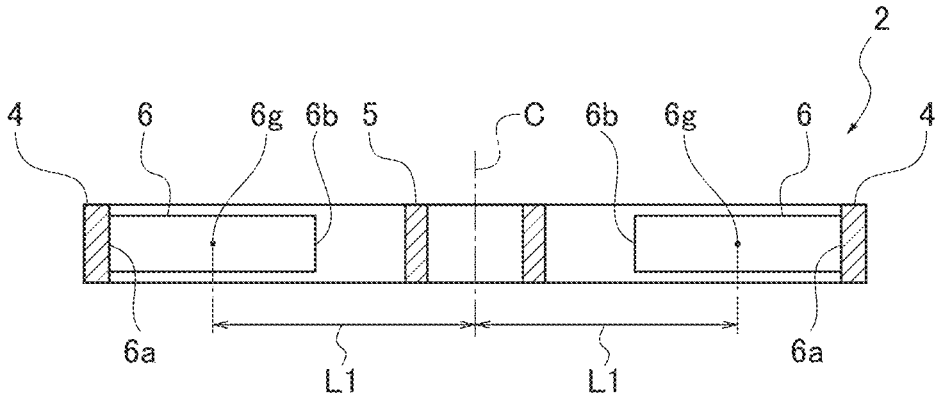
FIG. 3A is a cross-sectional view along a line I-I in FIG. 2, illustrating the balance wheel in a room temperature state before thermal deformation.
Figure 3B:
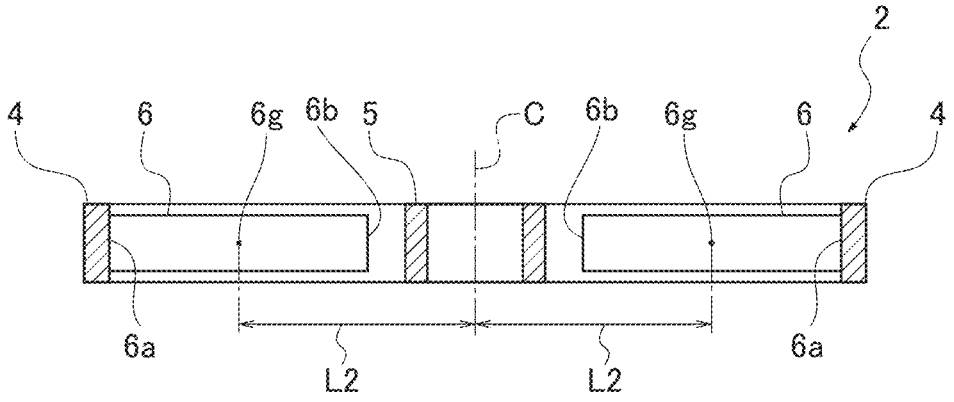
FIG. 3B is a cross-sectional view along the line I-I in FIG. 2 illustrating the balance wheel in a higher temperature state where temperature increases from the room temperature.

Next, the operation of the governor 10 in the portable timepiece according to the embodiment is described. FIGS. 3A and 3B are cross sectional views along a line I-I in FIG. 2. FIG. 3A shows the balance wheel in a room temperature state before the thermal deformation of the balance wheel. FIG. 3B shows the balance wheel in a higher temperature state where the temperature increases from the room temperature.

As shown in FIG. 3A, before the thermal expansion of the balance wheel 2, the center of gravity (also referred to as gravity center hereinafter) 6*g* of each weight member 6 is located at a position radially away from the center C of the balance staff 3 (see FIG. 2) by a distance L1. The spring constant of the balance spring 1 decreases when the temperature of the balance wheel 2 and/or the ambient temperature around the balance wheel 2 increase from the room temperature. The decrease in the spring constant of the balance spring 1 causes the oscillation period of the governor 10 to be longer.

When the temperature increases from the room temperature, the balance wheel 2 changes as follows. The arm portion 5 (see FIG. 2) and the rim portion 4 both have a very small coefficient of thermal expansion so that the arm portion 5 and the rim portion 4 hardly expand even when the temperature increases from the room temperature. However, the weight member 6 has a large coefficient of thermal expansion compared to the arm portion 5 and the rim portion 4 so that the weight member 6 expands when the temperature increases. When the temperature increases from the room temperature, the weight members 6 expand toward the center C from the respective outer ends 6*a* as shown in FIG. 3B. The gravity center 6*g* of each weight member 6 moves to a position radially away from the center C of the balance staff 3 by a distance L2 (<L1). The distance L2 is smaller than the distance L1.

As a result, after the temperature increases, the distribution of gravity centers of the balance wheel 2 in the radial direction thereof is moved in a radially inner direction (toward the center C) compared to the distribution before the temperature increases. Accordingly, the moment of inertia of the balance wheel 2 decreases in accordance with the temperature increase. The decrease in the moment of inertia of the balance wheel 2 causes the oscillation period of the governor 10 to be shorter. Specifically, the moment of inertia of the balance wheel 2 changes in accordance with the temperature change to cancel or suppress the change in the oscillation period of the governor 10 based on the change in the spring constant of the balance spring 1 including the coating film in accordance with the temperature change.

Note that since the change in the spring constant of the balance spring 1 including the coating film in accordance with the temperature change is understandable beforehand by experiments or the like, the change amount of the moment of inertia of the balance wheel 2 corresponding to the temperature change can be set to cancel the change in the oscillation period of the governor 10 based on the change in the spring constant of the balance spring 1. In this case, the change amount of the moment of inertia of the balance wheel 2 corresponding to the temperature change can be set by adjusting the length of each weight member 6, for example.

Thus, in the governor 10 of the first embodiment, the moment of inertia of the balance wheel 2 changes to cancel the change in the oscillation period of the governor 10 based on the change in the spring constant of the balance spring 1 including the coating film, and accordingly, the variation of the oscillation period due to the temperature change is suppressed. Therefore, it is possible to prevent or suppress deterioration in the accuracy of the rate of the portable timepiece due to the temperature change. Moreover, the strength of the balance spring 1 can be improved by DLC. Further, it is unnecessary for the coating such as DLC applied to the balance spring 1 to have a temperature compensation function (compensation against change in the spring constant due to the temperature change). Accordingly, the coating such as DLC is only required to have thickness enough to increase the strength of the balance spring 1 to desired strength. Resultingly, cost for forming a coating having unnecessarily larger thickness can be eliminated.

In addition, in the governor 10 of the first embodiment, each weight member 6 is fixed to the rim portion 4, which is a part of the support member, at only one end. Accordingly, distortion of the rim portion 4 and the weight member 6 due to the temperature change does not occur or may be reduced. Therefore, it is possible to prevent or suppress the durability of the balance wheel 2 from decreasing due to stress caused by the temperature change.

In the governor 10 of the first embodiment, each weight member 6 is supported by the rim portion 4 at the outer end 6*a* in the radial direction. Accordingly, the moving distance of the gravity center 6*g* of each weight member 6 in a radially inward direction can be maximized. Therefore, it is ensured that the governor 10 can maximize a range of the temperature compensation by the weight members 6.

Modified Examples

The governor 10 of the first embodiment uses the balance spring 1 in which DLC is applied to the surface of the base member as the coating film to improve the strength of the balance spring 1. However, the coating film may be a metal film, a polymer material film, an alumina film, a titanium dioxide ($TiO_2$) film, a silicon dioxide ($SiO_2$) film, or the like.

In the governor 10 of the first embodiment, the base member of the balance spring 1 is made of silicon but may be made of other materials. For example, the base member of the balance spring 1 may be made of quartz glass, a ceramic material or the like.

In the governor 10 of the first embodiment, the arm portion 5 and the rim portion 4 are respectively made of alloy in which nickel is added to iron, and the weight members 6 are made of copper. However, the combination of materials used for the arm portion 5, the rim portion 4, and the weight members 6 are not limited to the above materials used in this embodiment. Specifically, as long as each of the weight member 6 has a larger coefficient of thermal expansion compared to the arm portion 5 and the rim portion 4, materials such as nickel may be used for the weight member 6 instead of copper. In addition, as long as each of the arm portion 5 and the rim portion 4 has a smaller coefficient of thermal expansion compared to the weight member 6, materials such as quartz glass or silicon may be used for the arm portion 5 and the rim portion 4, for example.

Further, depending on the temperature characteristics of the balance spring to which the balance wheel 2 is applied, a material having negative temperature characteristics and constricting as the temperature increases (such as zirconium tungstate ($ZrW_2O_8$), silicon oxide ($Li_2O—Al_2O_3—SiO_2$), for example) may be used for the balance wheel 2.

The governor 10 of the first embodiment includes six weight members 6. However, the governor 10 may include two or more weight members 6 and the number of the weight members 6 is not limited to a specific number. It is preferable that the weight members 6 are disposed at symmetrical positions with respect to the center C, at equiangular intervals, or the like to equalize the weight distribution. In addition, the direction (i.e. the direction of the longitudinal axis or orientation) of each weight member 6 is not limited to the radial direction of the rim portion 4. However, it is necessary for the weight member 6 to be arranged in a direction other than a tangential direction of the rim portion 4, that is in a direction crossing the tangential direction.

In the governor 10 of the first embodiment, the weight member 6 has a constant shape in the radial direction, but the shape of the weight member 6 is not limited to the constant shape. The weight member 6 may have a shape that become wider, thicker and/or heavier as it goes inward in the radial direction. As described above, by adopting the weight members each having a shape that becomes heavier as it goes inward in the radial direction, the moving distance of the gravity center 6*g* in the radially inward direction can be larger than that of the gravity center 6*g* of the weight member having a constant width and/or thickness.

The governor 10 of the first embodiment includes the arm portion 5 and the rim portion 4 as the support member that supports the weight members 6. However, the governor 10 may include only the arm portion 5 that supports the weight members 6 without the rim portion 4. Further, the rim portion 4 does not necessarily have a circular ring shape that completely extends in a circumferential direction, but has an incomplete (partially discontinuous) ring shape.

Figure 4:
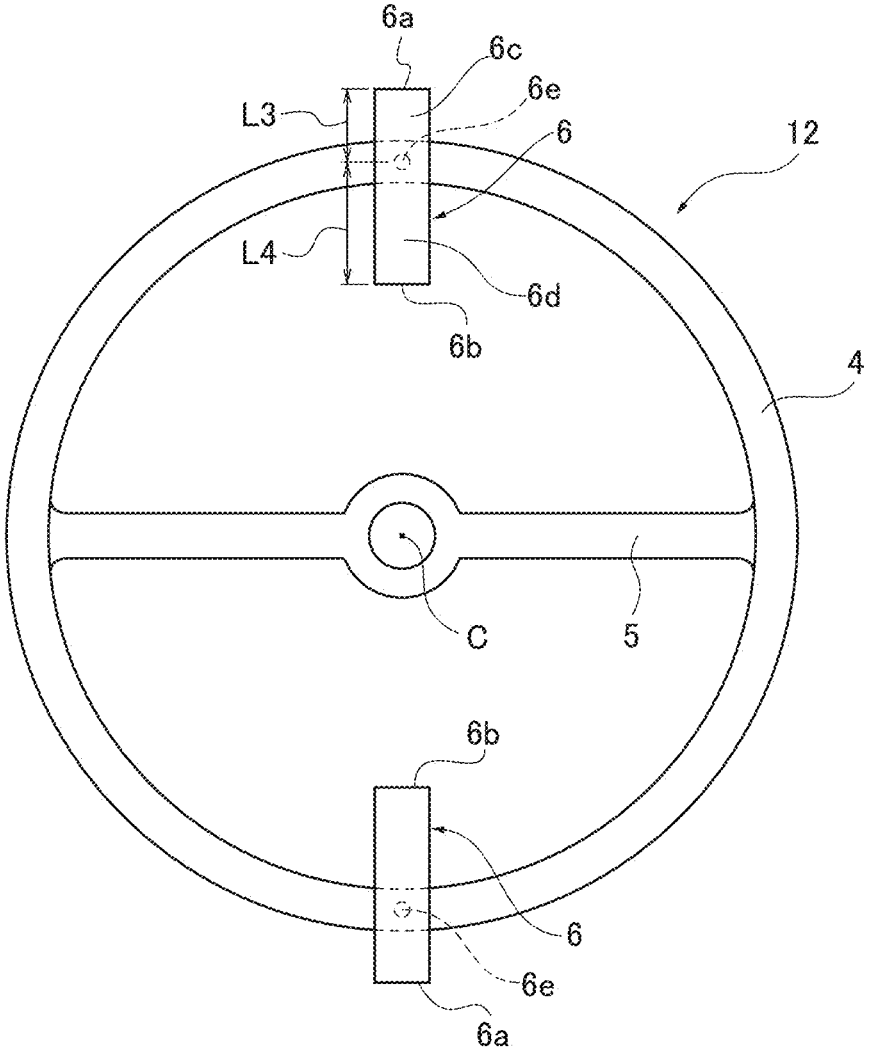
FIG. 4 is a plan view corresponding to FIG. 2 and illustrating a balance wheel including weight members, each of which is supported by a rim portion at a supported portion in which a length between the supported portion and a radially inner end of the weight member is longer than a length between the supported portion and a radially outer end of the weight member.

FIG. 4, which corresponds to FIG. 2, is a plan view illustrating a balance wheel 12 in which each weight member 6 is supported at a portion (supported portion) 6*e* by the rim portion 4. Among the entire length of the weight member 6, a length between the portion 6*e* and the outer end 6*a* in the radial direction is defined as a length L3, and a length between the portion 6*e* and the inner end 6*b* in the radial direction is defined as a length L4. The length L4 is longer than the length L3. In the governor 10 of the first embodiment, each weight member 6 is supported at the outer end 6*a* in the radial direction by the rim portion 4. However, as shown in FIG. 4, the weight member 6 is supported by the rim portion 4 at the portion 6*e* which is defined such that the length L4 between the portion 6*e* and the inner end 6*b* in the entire length (i.e. L3+L4) of the weight member 6 becomes longer than the length L3 between the portion 6*e* and the outer end 6*a*.

The governor including the balance wheel 12 described above is one of the embodiments of the timepiece according to the present invention. Specifically, the balance wheel 12 includes the weight members 6 each of which is supported by the rim portion 4 at the portion 6*e* instead of the ends 6*a*, 6*b*. Each of the weight members 6 includes a radially outer portion 6*c* and a radially inner portion 6*d*. The radially outer portion 6*c* is a portion located radially outward from the portion 6*e* supported by the rim portion 4. The radially inner portion 6*d* is a portion located radially inward from the portion 6*e*. In the balance wheel 12, the radially outer portion 6*c* extends radially outward and the radially inner portion 6*d* extends radially inward when the temperature increases.

Accordingly, the gravity center of the radially outer portion 6*c* moves radially outward and the gravity center of the radially inner portion 6*d* moves radially inward. The moving amount of each of the gravity centers is proportional to the lengths L3, L4 of the portions 6*c*, 6*d*. Accordingly, with regard to the movement of the gravity center in the radial direction, the moving amount of the gravity center of the radially outer portion 6*c* is smaller than the moving amount of the gravity center of the radially inner portion 6*d*. Therefore, the gravity center of the weight member 6 as a whole moves in the radially inward direction.

As a result, due to increase of the temperature, the distribution of the gravity centers of the balance wheel 12 moves radially inward, the moment of inertia of the balance wheel 12 decreases, and an effect same as the balance wheel 2 can be achieved. In other words, the governor including the balance wheel 12 configured as described above and the balance spring 1 can prevent or suppress deterioration in the accuracy of the rate of the portable timepiece caused by the temperature change, improve the strength of the balance spring 1, and eliminate cost for forming a coating having unnecessarily large thickness.

In the governor 10 of the first embodiment, the arm portion 5 and the rim portion 4, which form the support member, are respectively made of a material having a very small coefficient of thermal expansion at around the room temperature, while the weight member 6 is made of a material having a larger coefficient of thermal expansion at around the room temperature. However, the present invention is not limited to the above. For example, a governor including a balance wheel 2A shown in FIG. 5 or a balance wheel 2B shown in FIG. 6 is also one of the embodiments of the governor for the timepiece according to the present invention.

Figure 5:
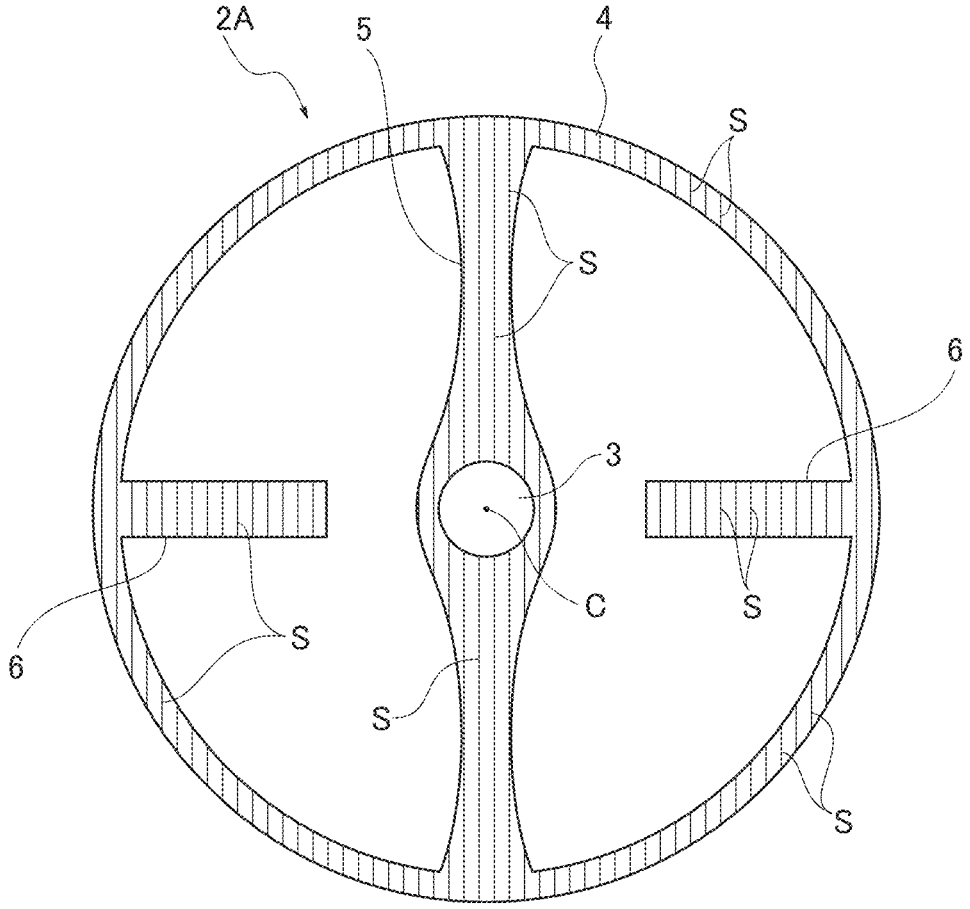
FIG. 5 is a plan view corresponding to FIG. 2 and illustrating a balance wheel which includes an arm portion, a rim portion, and weight members which are integrally formed by fiber-reinforced plastic.
Figure 6:
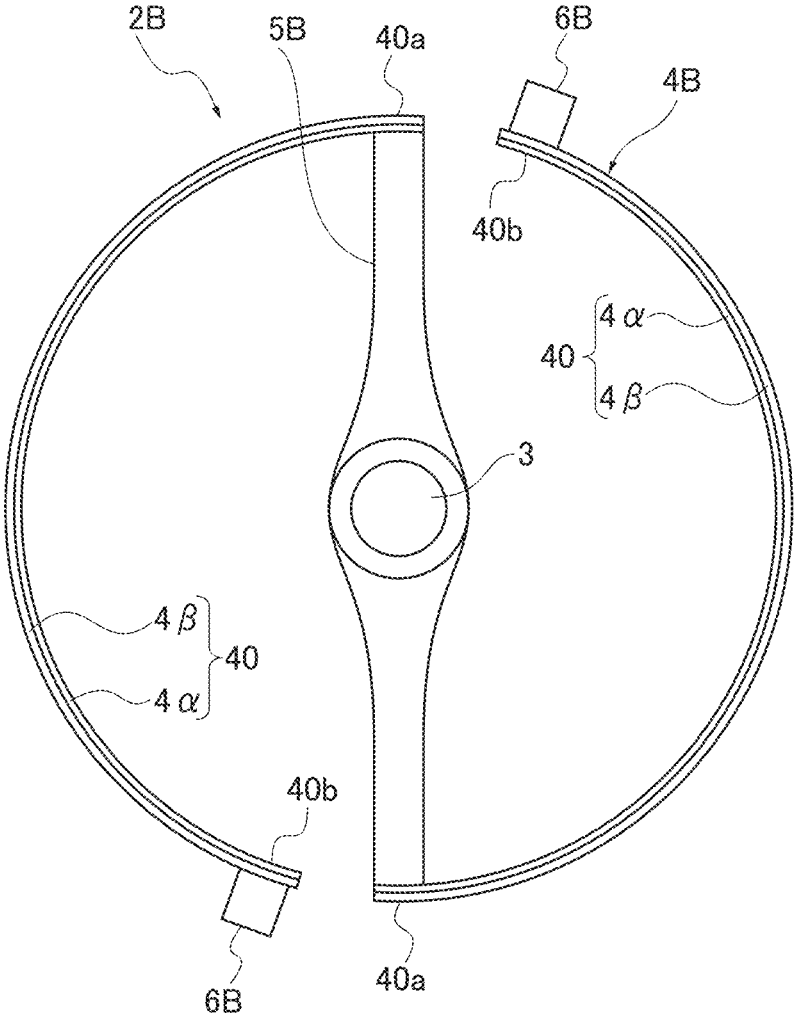
FIG. 6 is a plan view corresponding to FIG. 2 and illustrating a balance wheel which includes a rim portion formed from bimetal portions, each of which includes two metal plates having different coefficients of thermal expansion and radially fixed to each other.

Specifically, in the balance wheel 2A shown in FIG. 5, the arm portion 5, the rim portion 4 and a pair of the weight members 6 are integrally formed with fiber-reinforced plastic. The pair of the weight members 6 is arranged perpendicular to an axial direction of the arm portion 5. The extending directions of fibers S of the fiber-reinforced plastic are set to be parallel to the axial direction (i.e. the extending direction) of the arm portion 5. Here, the term "fiber-reinforced plastic" is a plastic composite material made by laminating prepreg sheets each formed by impregnating a synthetic resin as a main raw material to a woven fabric made with fibers having fiber orientations (in a state of continuous fibers (long fibers)) to increase the strength of the synthetic resin. Since the fibers have orientations, anisotropy appears in coefficient of thermal expansion and strength in accordance with the fiber orientations. In other words, the fiber-reinforced plastic has a smaller coefficient of thermal expansion in a direction along the fiber orientations and a larger coefficient of thermal expansion in a direction perpendicular to the fiber orientations. Therefore, the balance wheel 2A shown in FIG. 5 has a relatively smaller coefficient of thermal expansion in a direction parallel to the axial direction of the arm portion 5 and accordingly the balance wheel 2A hardly deforms in that direction. Also, the balance wheel 2A has a relatively large coefficient of thermal expansion in a direction perpendicular to the axial direction of the arm portion 5 and accordingly the balance wheel 2A easily deforms in that direction.

Thus, in the balance wheel 2A shown in FIG. 5, the arm portion 5 has the small coefficient of thermal expansion and hardly expands when the temperature increases from the room temperature. Thought the rim portion 4 thermally expands in the radial direction with the center C as a center, the expansion of the rim portion 4 is suppressed at first portions where the arm portion 5 is integrally formed and at portions in the vicinity of the first portions. This is because the deviation of the fiber orientations of the fibers S from the radial direction is small, the coefficient of thermal expansion is relatively small, and the arm portion 5 is provided. On the other hand, the deviation of the fiber orientations of the fibers S from the radial direction is large, and the coefficient of thermal expansion is relatively large at second portions where the weight members 6 are integrally formed and at portions in the vicinity of the second portions. Therefore, the rim portion 4 thermally expands to have an elliptical shape having a short axis direction along the axial direction of the arm portion 5 and a long axis direction along the axial directions of the weight members 6 when the temperature increases. On the other hand, the weight member 6 has a large coefficient of thermal expansion and accordingly extends toward the center C of the arm portion 5.

As a result, the distribution of the gravity centers of the balance wheel 2A moves radially inward, the moment of inertia of the balance wheel 2A decreases, and an effect same as the balance wheel 2 can be achieved. In other words, the governor including the balance wheel 2A configured as described above and the balance spring 1 with the DLC coating film applied to the surface of the silicon base member can prevent or suppress deterioration in the accuracy of the rate of the portable timepiece caused by the temperature change, improve the strength of the balance spring 1, and eliminate cost for forming a coating having unnecessarily large thickness.

Also in the balance wheel 2A, the amount of change in the moment of inertia of the balance wheel 2A due to increase of the temperature can be controlled by adjusting the length of the weight members 6, the coefficient of the thermal expansion of the fiber-reinforced plastic, or the like. In the balance wheel 2A shown in FIG. 5, the arm portion 5, the rim portion 4, and the pair of weight members 6 are integrally formed. Accordingly, the balance wheel 2A can be easily assembled, the weight members 6 cannot be obliquely fixed to the rim portion 4, and the temperature characteristics can be stable.

The fibers used for the fiber-reinforced plastic may be carbon fibers, glass fibers, boron fibers, aramid fibers, polyethylene fibers, or the like. The synthetic resin, which is a main material of the fiber-reinforced plastic, may be a thermosetting resin such as an unsaturated polyester, an epoxy resin, a phenol resin, or a thermoplastic resin such as a polyamide resin, methyl methacrylate.

As shown in FIG. 6, the balance wheel 2B includes a rim proton 4B and an arm portion 5B. The rim proton 4B includes two bimetal portions 40 each of which has a substantially arc shape to surround a half of the balance staff 3 on the radially outside of the balance staff 3 and is provided around the balance staff 3 as the center and on both sides of the arm portion 5B. The arm portion 5B connects the two bimetal portions 40 and the balance staff 3 in the radial direction. Here, each of the bimetal portions 40 is configured such that a first metal plate 4α and a second metal plate 4β are laminated and fixed to each other in the radial direction. The first metal plate 4α and the second metal plate 4β have different coefficients of thermal expansion. In the bimetal portion 40, the first metal plate 4α is located on a radially inner side. As the material of the first metal plate 4α, a low thermal expansion material such as an alloy (Invar (registered trademark), for example) in which nickel is added to iron is used. The second metal plate 4β is located on a radially outer side. As the material of the second metal plate 4β, a high thermal expansion material such as brass is used.

Further, the arm portion 5B has a band shape radially extending through the balance staff 3, and the balance staff 3 is inserted into the longitudinal center of the arm portion 5B. In addition, the arm portion 5B is made of a low thermal expansion material such as Invar (registered trademark) same as the first metal plate 4α. Each end of the arm portion 5B is fixed to one end of each bimetal portion 40. Thus, the bimetal portion 40 includes a fixed end 40*a* fixed to the arm portion 5B and a free end 40*b* opposed to the fixed end 40*a*. In addition, the two bimetal portions 40 are placed to be point symmetry with respect to the balance staff 3. The two bimetal portions 40 form the rim portion 4B that surrounds substantially the entire circumference of the balance staff 3. Each of the free ends 40*b* is provided with the weight portion 6B.

With the above configuration, the free ends 40*b* of the bimetal portions 40 move and deform radially inward due to difference in coefficients of thermal expansion between the two metal plates (i.e. the first metal plate 4α and the second metal plate 4β) when the temperature increases. Accordingly, the weight portions 6B move radially inward and the moment of inertia of the balance wheel 2B decreases. As a result, an effect same as the balance wheel 2 can be achieved. In other words, the governor including the balance wheel 2B configured as described above and the balance spring 1 with the DLC coating film applied to the surface of the silicon base member can prevent or suppress deterioration in the accuracy of the rate of the portable timepiece caused by the temperature change, improve the strength of the balance spring 1, and eliminate cost for forming a coating having unnecessarily large thickness.

Figure 7:
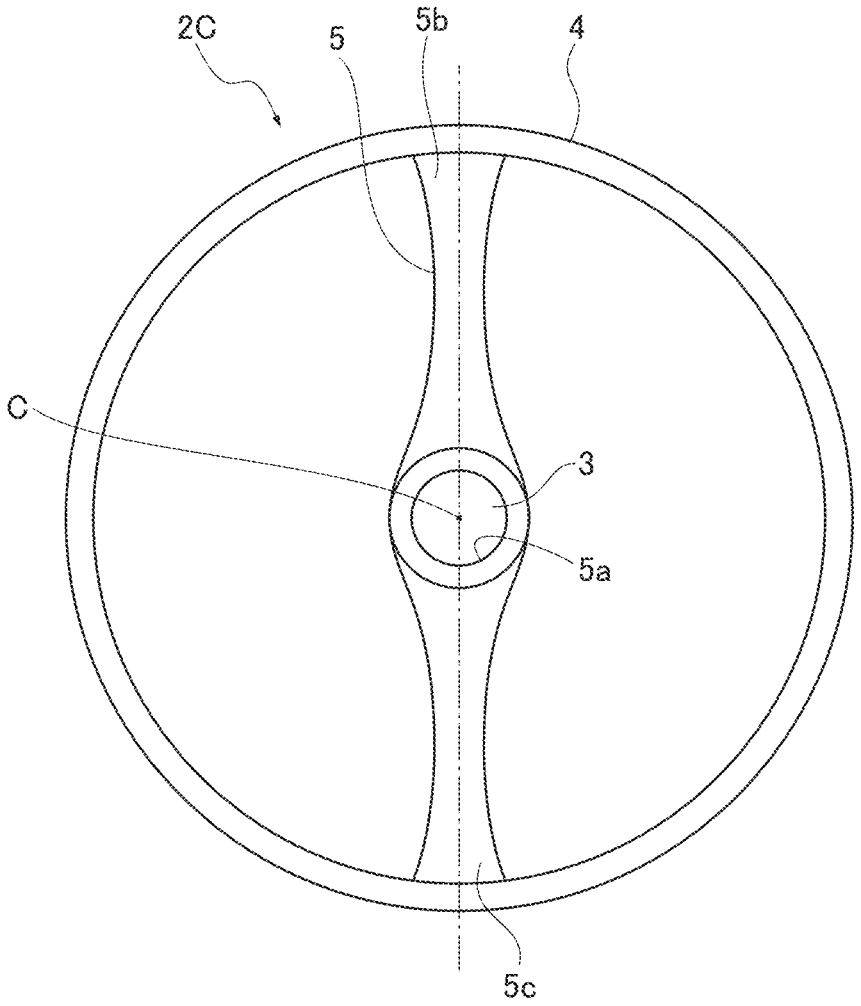
FIG. 7 is a plan view corresponding to FIG. 2 and illustrating a balance wheel which includes a balance staff, an arm portion, and a rim portion.

Further, in the governor 10 of the first embodiment, the balance wheel 2 includes the arm portion 5 and the rim portion 4, which form the support member, and the weight members 6. However, the present invention is not limited to the above embodiment. As shown in FIG. 7, it is also possible to use a balance wheel 2C which includes the balance staff 3, the arm portion 5, and the rim portion 4 but does not include weight members.

Here, in the case where the balance wheel 2C shown in FIG. 7 is made of a material such as brass which has positive temperature characteristics and expands in accordance with the temperature increase, the balance wheel 2C expands and the arm portion 5 extends to increase the diameter of the balance wheel 2C when the temperature increases. Therefore, after the temperature has increased, the distribution of the gravity centers in the radial direction of the balance wheel 2C moves radially outward (away from the center C) compared to that of the gravity centers before the temperature increases. Accordingly, the moment of inertia of the balance wheel 2C increases in accordance with the temperature increase. The increase in the moment of inertia of the balance wheel 2C causes the oscillation period of the governor 10 to be longer.

On the other hand, in the balance spring having the coating film of silicon dioxide applied to the base member made of silicon, for example, the spring constant of the balance spring including the coating film does not decrease even when the temperature increases, which causes the oscillation period of the governor 10 to be shorter.

Therefore, even when the balance wheel 2C shown in FIG. 7 is made of brass, combining the balance wheel 2C with the balance spring having the positive temperature coefficient in which the spring constant of the balance spring including the coating film increases in accordance with the temperature increase (e.g. the silicon base member with silicon dioxide coating film) offsets or cancels the change in the oscillation period based on the change in the moment of inertia of the balance wheel 2C and the change in the oscillation period based on the change in the spring constant of the balance spring including the coating film. As a result, it is possible to prevent or suppress deterioration in the accuracy of the rate of the portable timepiece caused by the temperature change.

On the other hand, in the case where the balance wheel 2C shown in FIG. 7 is made of a material such as zirconium tungstate which has the negative temperature characteristics and contracts in accordance with the temperature increase, the arm portion 5 contracts and the diameter of the balance wheel 2C decreases when the temperature increases. Accordingly, the distribution of the gravity centers of the balance wheel 2C moves radially inward, the moment of inertia of the balance wheel 2C decreases, and an effect same as the balance wheel 2 shown in FIG. 2 can be achieved. Specifically, in the governor including the balance spring 1 shown in FIG. 1 and the balance wheel 2C made of the material having the negative temperature characteristics, the change in the oscillation period based on the change in the moment of inertia of the balance wheel 2C and the change in the oscillation period based on the change in the spring constant of the balance spring including the coating film are offset or canceled each other. As a result, it is possible to prevent or suppress deterioration in the accuracy of the rate of the portable timepiece caused by the temperature change.

As described above, the balance wheel used for the governor 10 of this embodiment may have any structure or configuration as long as the moment of inertia of the balance wheel can be controlled. It is possible to appropriately select a balance wheel capable of canceling the change in oscillation period of the governor 10 based on the change in the spring constant of the balance spring including the coating film.

Experimental Example I

Figure 8:
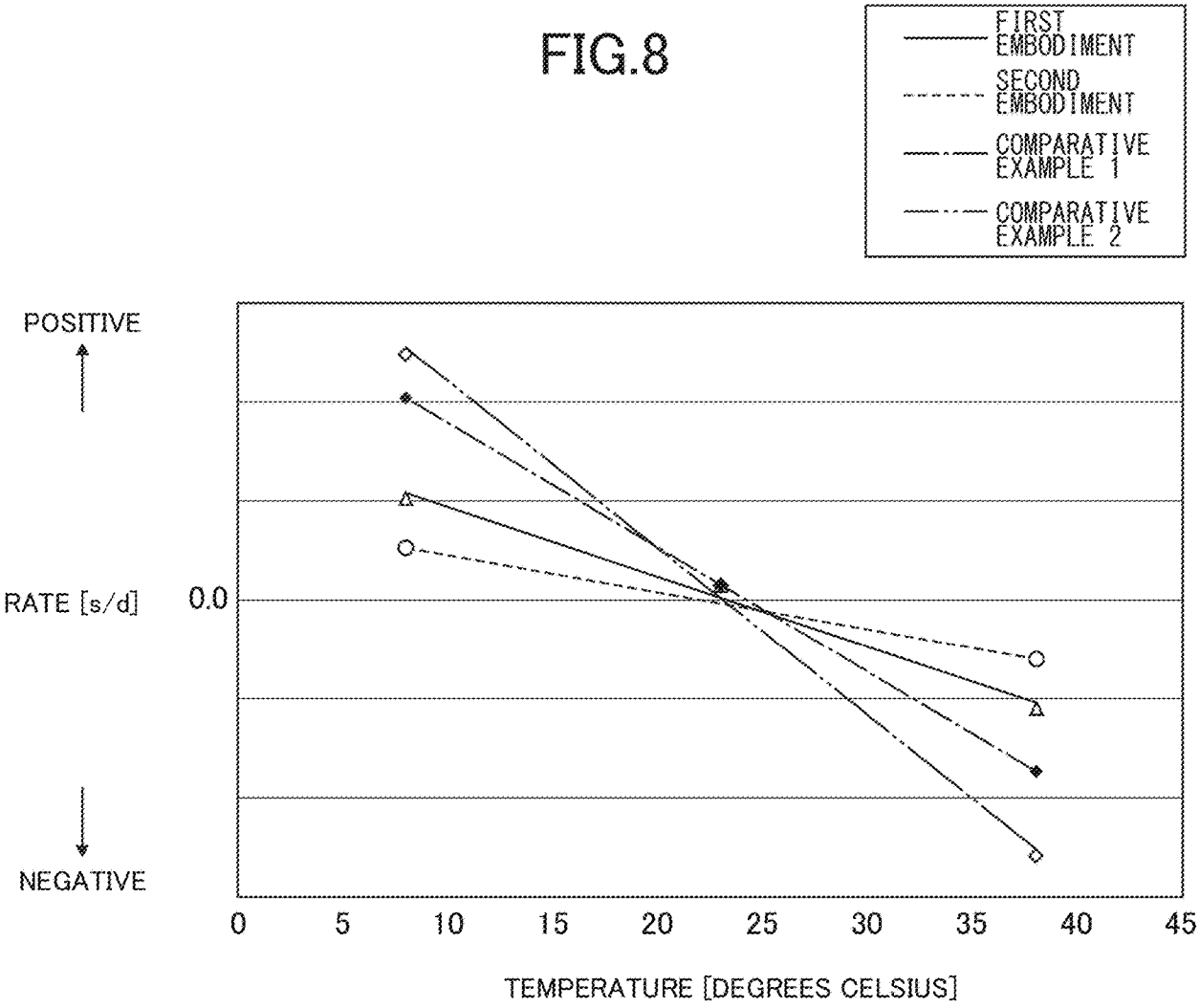
FIG. 8 is a graph showing experimental results regarding temperature characteristics (relationship between temperature and rate) of governors of the first and second embodiments according to the present invention and governors of comparative examples 1 and 2.

FIG. 8 is a graph showing experimental results regarding temperature characteristics (relationship between temperature and rate) of the governor 10 of the first embodiment, a governor of another embodiment (a second embodiment) according to the present invention, and governors of comparative examples 1, 2. In the graph of FIG. 8, a solid line shows the temperature characteristics of the governor 10 of the first embodiment, and a dotted line shows the temperature characteristics of the governor of the second embodiment. An alternate long and short dash line shows the temperature characteristics of the comparative example 1 to which the present invention is not adopted. An alternate long and two short dashes line shows the temperature characteristics of the comparative example 2 to which the present invention is not adopted. Note that these lines are obtained by connecting plots of experimental data at temperatures of 8 degrees Celsius, 23 degrees Celsius, and 38 degrees Celsius.

Here, the governor 10 of the first embodiment (shown in the solid line) includes the balance spring and the balance wheel shown in FIG. 2. The balance spring of the first embodiment includes the base member made of silicon and the coating film of DLC having a thickness of 1 μm. The governor of the second embodiment (shown in dotted line) includes the balance spring and the balance wheel shown in FIG. 2. The balance spring of the second embodiment includes the base member made of silicon and the coating film of the synthetic resin having a thickness of 1 μm. Note that "the coating film of the synthetic resin" in the governor of the second embodiment (shown in dotted line) is a coating film of a synthetic resin including a polyparaxylylene polymer, for example. The governor of the comparative example 1 (shown in the alternate long and short dash line) includes a balance spring (a silicon base member) with no coating, and a balance wheel made of free-cutting brass. The governor of the comparative example 2 (shown in the alternate long and two short dashes line) includes a balance spring and a balance wheel made of free-cutting brass. The balance spring of the comparative example 2 includes a silicon base member and a DLC coating film having a thickness of 1 μm.

As can be seen from the graph of the temperature characteristics shown in FIG. 8, the comparative example 1 has poor temperature characteristics since the silicon balance spring and the conventional balance wheel (made of free-cutting brass) have temperature characteristics which delay the oscillation period in accordance with the temperature increase. The comparative example 2, in which the DLC coating is applied to the balance spring of the comparative example 1 (the silicon base member), has the worse temperature characteristics than that of the comparative example 1 since the DLC coating acts to deteriorate the temperature characteristics of the balance spring.

On the other hand, it is proven that with the governor 10 of the first embodiment including the balance wheel which differs from that of the comparative example 2, the rigidity of the silicon balance spring is improved with DLC coating, the temperature characteristics deteriorated by the DLC coating are improved, the variation of the rate in accordance with the temperature is decreased compared to the comparative examples 1, 2.

Also, it is proven that with the governor of the second embodiment, the rigidity of the silicon balance spring is improved with the synthetic resin coating, the temperature characteristics are improved, the variation of the rate in accordance with the temperature is decreased compared to the comparative examples 1, 2.

Figure 9:
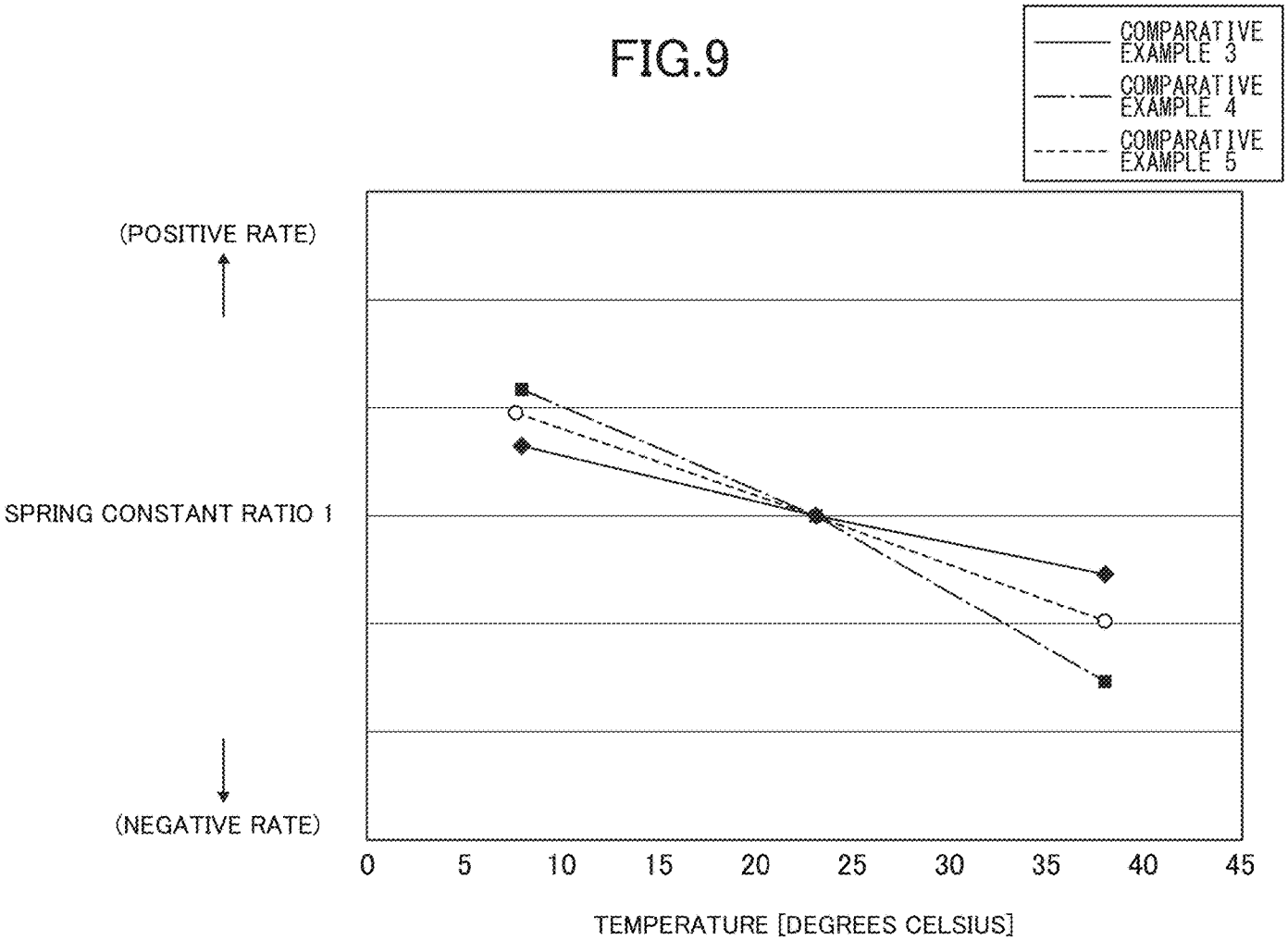
FIG. 9 is a graph showing an influence on spring constants of the balance springs in which a DLC coating film or a synthetic resin coating film is applied to respective base members.

Further, FIG. 9 is a graph showing an influence on the spring constant of the balance spring when the coating film is applied to the silicon base member. In the graph of FIG. 9, a solid line shows the temperature characteristics of the spring constant of a base member which has a spiral shape (the silicon balance spring with no coating) according to comparative example 3. An alternate long and short dash line shows the temperature characteristics of the spring constant of a balance spring according to comparative example 4. The balance spring of the comparative example 4 includes a silicon base member, and a DLC coating applied to the base member and having a thickness of 1 μm. A dotted line shows the temperature characteristics of the spring constant of a balance spring according to comparative example 5. The balance spring of comparative example 5 includes a silicon base member, and a synthetic resin coating applied to the base member and having a thickness of 1 μm. Note that the balance spring of the comparative example 4 is the balance spring used for the governor 10 of the first embodiment. The balance spring of the comparative example 5 is the balance spring used for the governor of the second embodiment. These three lines are obtained by connecting plots of experimental data at temperatures of 8 degrees Celsius, 23 degrees Celsius, and 38 degrees Celsius. The spring constant at 23 degrees Celsius is set to 1.

As shown in FIG. 9, the spiral base member of the comparative example 3 (the silicon balance spring with no coating) has characteristics (negative temperature coefficient) in which the spring constant decreases when the temperature increases. Also, the balance spring of the comparative example 4 which includes the base member with the DLC coating, and the balance spring of the comparative example 5 which includes the base member with the synthetic resin coating respectively have characteristics (negative temperature coefficient) in which the spring constants decrease when the temperature increases. However, the spring constants of the balance springs according to the comparative examples 4, 5 considerably decrease compared to the comparative example 3 when the temperature increases. That is, it is proven that the temperature coefficient of the spring constant of the balance spring in which the base member includes the DLC coating film is smaller than that of the spring constant of the base member. Also, it is proven that the temperature coefficient of the spring constant of the balance spring in which the base member includes the synthetic resin coating film is smaller than that of the spring constant of the base member.

As described above, by applying the coating film to the base member, the temperature coefficient of the spring constant of the balance spring decreases compared to that of the spring constant of the base member. Applying the above balance spring to the balance wheel having a relatively small temperature coefficient (negative temperature coefficient) of the moment of inertia when the temperature increases (i.e. the balance wheel having a relatively high suppressing effect on increase in the moment of inertia when the temperature increases) can appropriately suppress the variation of the rate in accordance with the temperature.

Note that the coating film applied to the base member to decrease the temperature coefficient of the spring constant of the balance spring compared to that of the spring constant of the base member is not limited to the DLC coating film and the synthetic resin coating film. Other coating films may be applied to the base member as long as the temperature coefficient of the spring constant of the balance spring similar to the characteristics of the comparative examples 4 or 5 in FIG. 9 is achieved.

Experimental Example II

Figure 10:
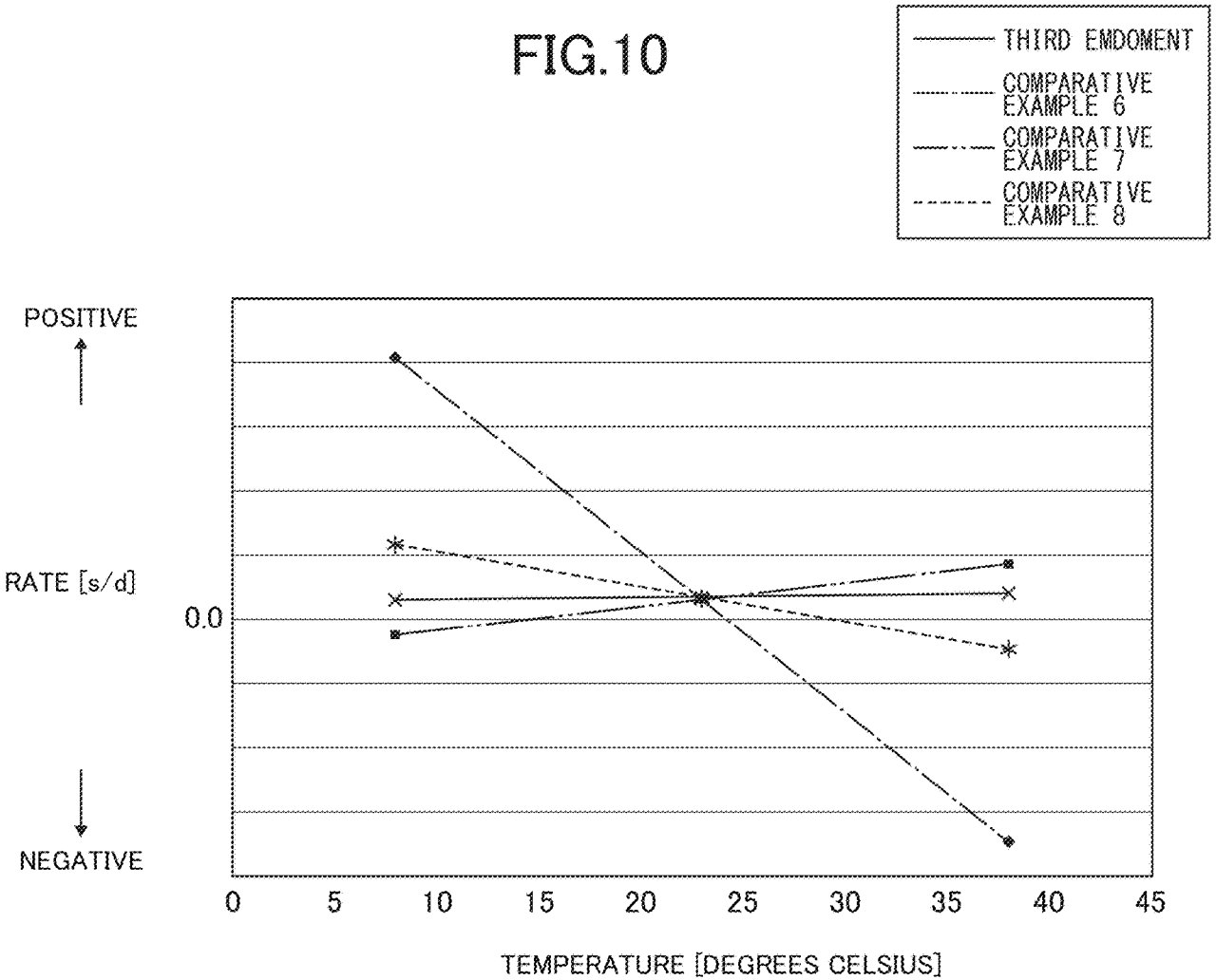
FIG. 10 is a graph showing experimental results regarding temperature characteristics (relationship between temperature and rate) of a governor of a third embodiment and governors of comparative examples 6, 7, and 8.

FIG. 10 is a graph showing experimental results regarding temperature characteristics (relationship between temperature and rate) of a governor of another embodiment (a third embodiment) according to the present invention and governors of comparative examples 6, 7, and 8. In the graph of FIG. 10, a solid line shows the temperature characteristics of the governor according to the third embodiment. Further, an alternate long and short dash line shows the temperature characteristics of the comparative example 6 to which the present invention is not adopted. An alternate long and two short dashes line shows the temperature characteristics of the comparative example 7 to which the present invention is not adopted. A dotted line shows the temperature characteristics of the comparative example 8 to which the present invention is not adopted. Note that these four lines are obtained by connecting plots of experimental data at temperatures of 8 degrees Celsius, 23 degrees Celsius, and 38 degrees Celsius.

Here, the governor of the third embodiment (shown in the solid line) includes a balance spring and the balance wheel shown in FIG. 2. The balance spring of the third embodiment includes a base member made of silicon, and a coating film of silicon dioxide ($SiO_2$) applied to the base member and having a thickness of 1 μm. A governor of the comparative example 6 (shown in the alternate long and short dash line) includes a silicon balance spring with no coating (a silicon base member) and a balance wheel made of free-cutting brass. The comparative example 6 is the same as the comparative example 1 shown in FIG. 7. A governor of the comparative example 7 (shown in the alternate long and two short dashes line) includes a balance spring and a balance wheel made of free-cutting brass. The balance spring of the comparative example 7 includes a base member made of silicon, and a coating film of silicon dioxide ($SiO_2$) applied to the base member and having a thickness of 5 μm. A governor of the comparative example 8 (shown in the dotted line) includes a silicon balance spring with no coating (a silicon base member) and the balance wheel shown in FIG. 2.

As can be seen from the graph of the temperature characteristics shown in FIG. 10, the comparative example 6 has poor temperature characteristics since the silicon balance spring and the conventional balance wheel (made of free-cutting brass) have temperature characteristics which delay the oscillation period. The comparative example 7, in which the silicon dioxide coating having the thickness of 5 μm is applied to the balance spring of the comparative example 6, improves the temperature characteristics in the governor as a whole since the silicon dioxide coating acts to cancel the temperature characteristics of the balance wheel made of free-cutting brass. However, it takes several tens of hours to apply the silicon dioxide coating to have the thickness of 5 μm, which undesirably increases manufacturing cost.

The comparative example 8 is modified from the comparative example 6 by replacing the balance wheel of the comparative example 6 with the balance wheel used for the governor of the third embodiment. The temperature characteristic of the comparative example 8 is considerably improved compared to the comparative example 5. On the other hand, it is proven that with the governor of the third embodiment, the rigidity of the silicon balance spring is improved with silicon dioxide coating, the temperature characteristics of the silicon balance spring is improved, the temperature characteristics of the governor as a whole is improved with the balance wheel compared to the comparative examples 6, 7 and 8, and the variation of the rate based on the temperature is substantially completely suppressed.

Figure 11:
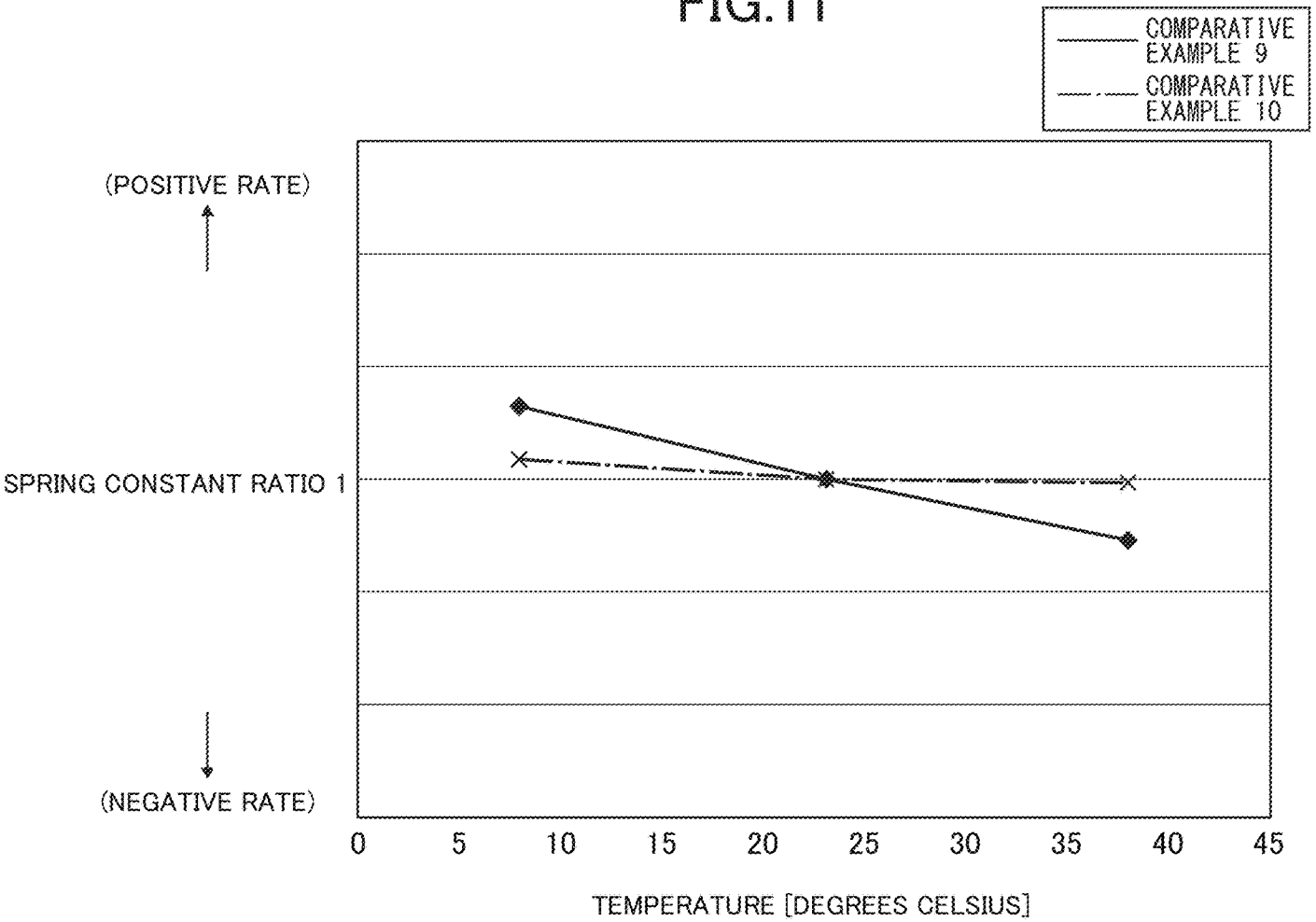
FIG. 11 is a graph showing an influence on spring constants of the balance springs in which a silicon dioxide coating film is applied to respective base members.

FIG. 11 is a graph showing an influence on the spring constant of the balance spring when the silicon dioxide coating film is applied to the silicon base member. In the graph of FIG. 11, a solid line shows the temperature characteristics of the spring constant of a base member which has a spiral shape (the silicon balance spring with no coating) according to a comparative example 9 (same as the comparative example 3). An alternate long and short dash line shows the temperature characteristics of the spring constant of a balance spring according to a comparative example 10. The balance spring of the comparative example 10 includes a silicon base member and a silicon dioxide coating applied to the base member and having a thickness of 1 μm. Note that the balance spring of the comparative example 10 is the balance spring used for the governor of the third embodiment. These two lines are obtained by connecting plots of experimental data at temperatures of 8 degrees Celsius, 23 degrees Celsius, and 38 degrees Celsius. The spring constant at 23 degrees Celsius is set to 1.

As shown in FIG. 11, the spiral base member of the comparative example 9 (the silicon balance spring with no coating) has characteristics (negative temperature coefficient) in which the spring constant decreases when the temperature increases. On the other hand, the balance spring of the comparative example 10 which includes the base member with the silicon dioxide coating having the thickness of 1 μm also has characteristics (negative temperature coefficient) in which the spring constant decreases when the temperature increases. However, the spring constant of the balance spring in the comparative example 10 does not decrease as much as that of the balance spring in the comparative example 9 when the temperature increases. That is, it is proven that the temperature coefficient of the spring constant of the balance spring in which the base member includes the silicon dioxide coating film is larger than that of the spring constant of the base member.

As described above, by applying the coating film to the base member, the temperature coefficient of the spring constant of the balance spring become larger than that of the spring constant of the base member. Applying the above balance spring to the balance wheel having a relatively large temperature coefficient (negative temperature coefficient) of the moment of inertia when the temperature increases (i.e. the balance wheel having a relatively low suppressing effect on increase in the moment of inertia when the temperature increases) can appropriately suppress the variation of the rate in accordance with the temperature.

Note that the coating film applied to the base member to increase the temperature coefficient of the spring constant of the balance spring compared to the temperature coefficient of the spring constant of the base member is not limited to the silicon dioxide coating film. Other coating films may be applied to the base member as long as the temperature coefficient of the spring constant of the balance spring same as the characteristics of the comparative example 9 in FIG. 11 is achieved.

What is claimed is:

1. A governor for a timepiece comprising:

a balance spring, and a balance wheel, wherein the balance spring comprises a base member that has a spiral shape, and a coating film that is applied to a surface of the base member to improve strength of the balance spring, wherein a spring constant of the balance spring changes in accordance with a temperature change, wherein a moment of inertia of the balance wheel changes in accordance with the temperature change, wherein a change in an oscillation period due to the temperature change is suppressed by a change in the spring constant of the balance spring and by a change in the moment of inertia of the balance wheel, wherein the balance wheel comprises a balance staff, a support member that extends radially outward from the balance staff as a center, and a weight member that is supported by the support member and extends radially inward from a supported portion of the weight member, and wherein a coefficient of thermal expansion of the weight member in accordance with the temperature change is larger than a coefficient of thermal expansion of the support member.

2. The governor according to claim 1, wherein a temperature coefficient of the spring constant of the balance spring is smaller than that of a spring constant of the base member.

3. The governor according to claim 2, wherein the coating film is made from a diamond-like carbon or a resin.

4. The governor according to claim 1, wherein a temperature coefficient of the spring constant of the balance spring is larger than that of a spring constant of the base member.

5. The governor according to claim 4, wherein the coating film is made from silicon dioxide.

6. The governor according to claim 1, wherein the balance wheel comprises a weight member that changes the moment of inertia of the balance wheel in accordance with the temperature change.

7. The governor according to claim 1, wherein the weight member includes a radially inner end and a radially outer end in an entire length of the weight member that extends in a radial direction, and wherein the weight member is supported by the support member at a position that is defined such that a length between a supporting position of the supporting member and the radially inner end is longer than a length between the supporting position and the radially outer end.

8. The governor according claim 1, wherein the weight member is supported by the support member at a radially outer end in an entire length of the weight member that extends in a radial direction.

* * * * *